US005342209A

United States Patent [19]

Carney et al.

[11] Patent Number: 5,342,209

[45] Date of Patent: Aug. 30, 1994

[54] CONNECTOR STRIP ASSEMBLY WITH GROUND CONNECTION

[75] Inventors: William V. Carney, Oyster Bay; Michael Fasano, Huntington, both of N.Y.

[73] Assignee: Porta Systems Corp., Syosset, N.Y.

[21] Appl. No.: 83,978

[22] Filed: Jun. 28, 1993

[51] Int. Cl.[5] ..... H01R 4/66

[52] U.S. Cl. ..... 439/92; 439/94; 439/532

[58] Field of Search ..... 439/92, 94, 108, 620, 439/719, 532

[56] References Cited

U.S. PATENT DOCUMENTS

| | | | |
|---|---|---|---|
| 4,118,091 | 10/1978 | Frisby . | |
| 4,281,885 | 8/1981 | Forberg et al. . | |
| 4,634,209 | 1/1987 | Forberg et al. | 439/719 X |
| 5,000,703 | 3/1991 | Biederstedt et al. | 439/92 X |
| 5,160,273 | 11/1992 | Carney | 439/108 |

*Primary Examiner*—Eugene F. Desmond

*Attorney, Agent, or Firm*—Fitzpatrick, Cella, Harper & Scinto

[57] ABSTRACT

A grounding arrangement for connector strips which are mounted across the edges of parallel rails. A ground element is connected to the ground system inside the connector strip and extends though the back of the strip to a connector clip. The connector clip is engaged with a flange which extends out from one of the rails.

12 Claims, 6 Drawing Sheets

FIG. 3
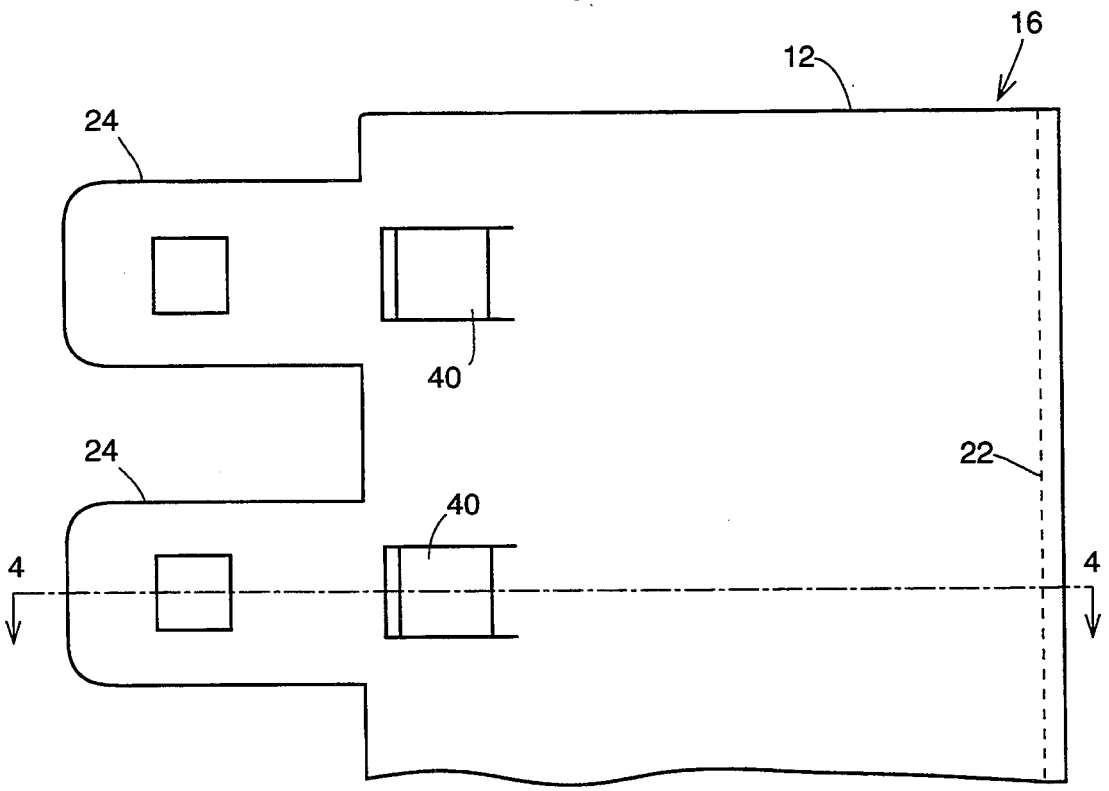
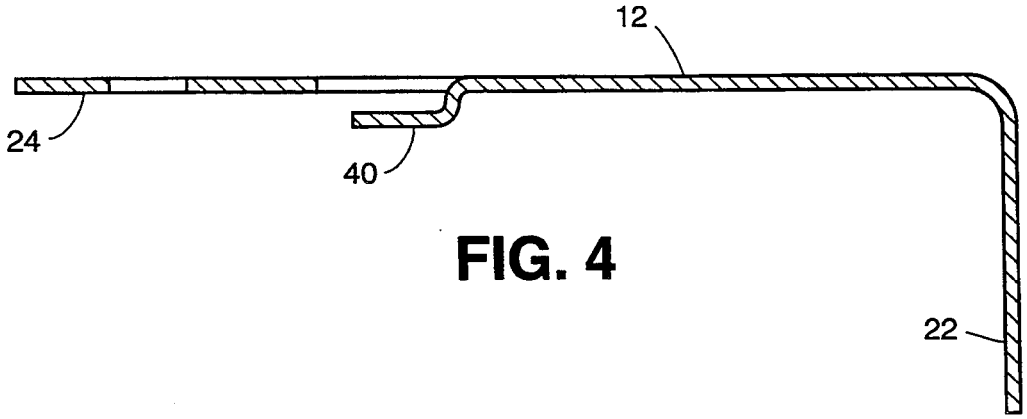
FIG. 4

CONNECTOR STRIP ASSEMBLY WITH GROUND CONNECTION

BACKGROUND OF THE INVENTION

1. Field of the Invention

This invention relates to electrical connector assemblies and more particularly it concerns a novel connector strip and mounting assembly which provides safe and convenient ground connection to a ground bus inside the connector strip.

2. Description of Related Art

U.S. Pat. No. 5,160,273 describes a multiple connector strip of the general type to which this invention pertains. This connector strip comprises an elongated insulative block in which are contained a plurality of closely spaced electrical signal contacts in the form of spring fingers. A ground strip extends along the inside of the block and this ground strip itself has spring fingers. The block is also provided with apertures into which printed circuit elements can be inserted; and when these elements are inserted into the connector strip they contact and make electrical connection with the spring fingers. U.S. Pat. No. 4,281,885 shows another form of connector strip, which does not have an internal ground strip. This patent shows a connector strip mounting arrangement comprising a pair of metal earthing strips having tags along their upper edges. These tags serve to mount the connector strips and also to supply ground potential to fitted extra equipment such as a surge diverter.

U.S. Pat. No. 4,118,091 also shows a connector strip which is mounted on tabs which extend up from an earthing or ground element. In this patent, additional tabs, separate from the mounting tabs, are bent up from the bottom of the ground element and contact surge diverters inside the connector strip.

A problem arises when the connector strip mounting tab is also used to provide ground connection to a ground strip inside the connector strip. Specifically, it is difficult to make adequate contact so that substantial amounts of current can be handled in case of voltage surges. As a result, when such voltage surges occur, the electrical conductors overheat and in some cases may even melt the plastic material of the connector strip.

Another problem occurs when separate ground tabs are bent up out of the bottom of the ground element, particularly when the connector strip must be held a substantial distance above the ground element. The problem occurs because the ground tab must be quite long, and since it is cantilevered, it cannot be firmly fixed in position.

SUMMARY OF THE INVENTION

The present invention overcomes the above described problems of the prior art and provides a novel mounting and grounding structure in which the grounding element is separate from the mounting element to provide good electrical contact and in which the grounding element is formed so that it has minimum length and minimal flexure and instability.

According to the invention there is provided a novel connector strip assembly which comprises at least one connector strip made up of an elongated insulative block containing a plurality of closely spaced connectors. A ground strip is also contained inside the block. A mounting structure is provided to mount the connector strip. The mounting structure comprises a pair of spaced apart, elongated rails; and the connector strip extends across and is removably mounted on the upper edges of the rails. At least one of the rails is electrically conductive and has a flange which extends out from the rail below the connector strip. An electrically conductive clip is mounted on the bottom of, and is connected to, the ground strip inside the connector strip. The clip is positioned on the connector strip such that it engages and makes electrical contact with the flange when the connector strip is mounted on the rails.

In one embodiment the flange is punched out from the rail behind the connector strip. In another embodiment the flange is formed on an adapter bracket which is mounted on the rail.

BRIEF DESCRIPTION OF THE DRAWINGS

FIG. 3 is an enlarged fragmentary edge view of a mounting rail used in the assembly of FIG. 1;

FIG. 4 is a view taken along line 4—4 of FIG. 3;

DETAILED DESCRIPTION OF THE PREFERRED EMBODIMENT

Figure 1:
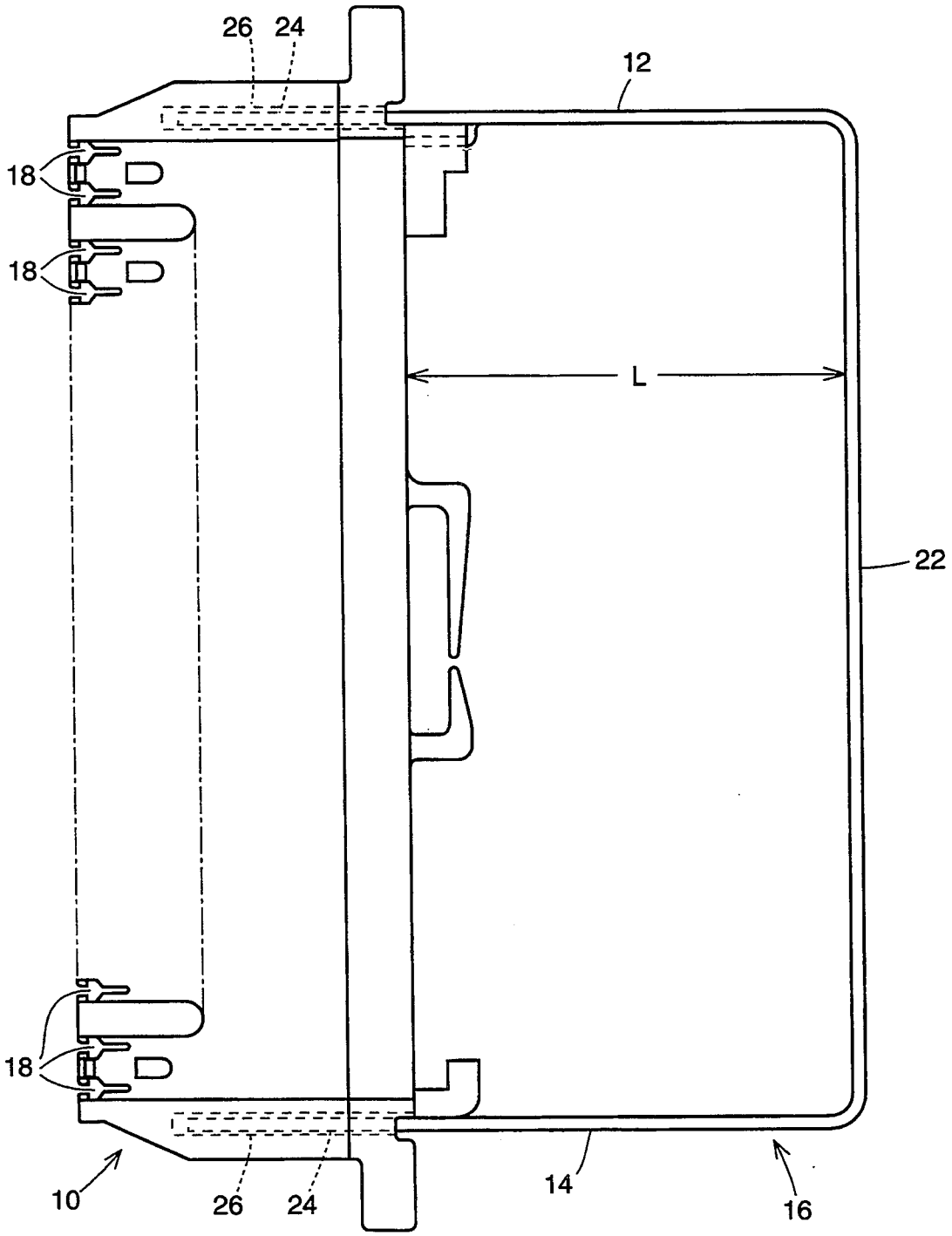
FIG. 1 is a top view of a connector strip and mounting assembly according to a first embodiment of the present invention.

The first embodiment of the invention is shown in FIGS. 1–5. As can be seen in FIG. 1, an elongated connector strip 10, which may be like that shown in U.S. Pat. No. 5,160,273, is mounted to extend across the upper edges of two rails 12 and 14 of a mounting frame 16.

The connector strip 10 is formed of plastic and is formed along its front side (left side as viewed in FIG. 1) with a series of wire holding slots 18. Within each slot 18 is an insulation displacement connector (not shown) which has its own slot into which a wire may be pressed. The slot 18 holds the insulation portion of the wire tightly to provide strain relief, while the slot in the connector holds the core or conductor portion of the wire tightly to make good electrical contact. As explained in U.S. Pat. No. 5,160,273, there are two rows of these connectors; and each connector in one row has a spring finger portion inside the strip which presses against and makes electrical contact with a counterpart spring finger in the other row.

Figure 2:
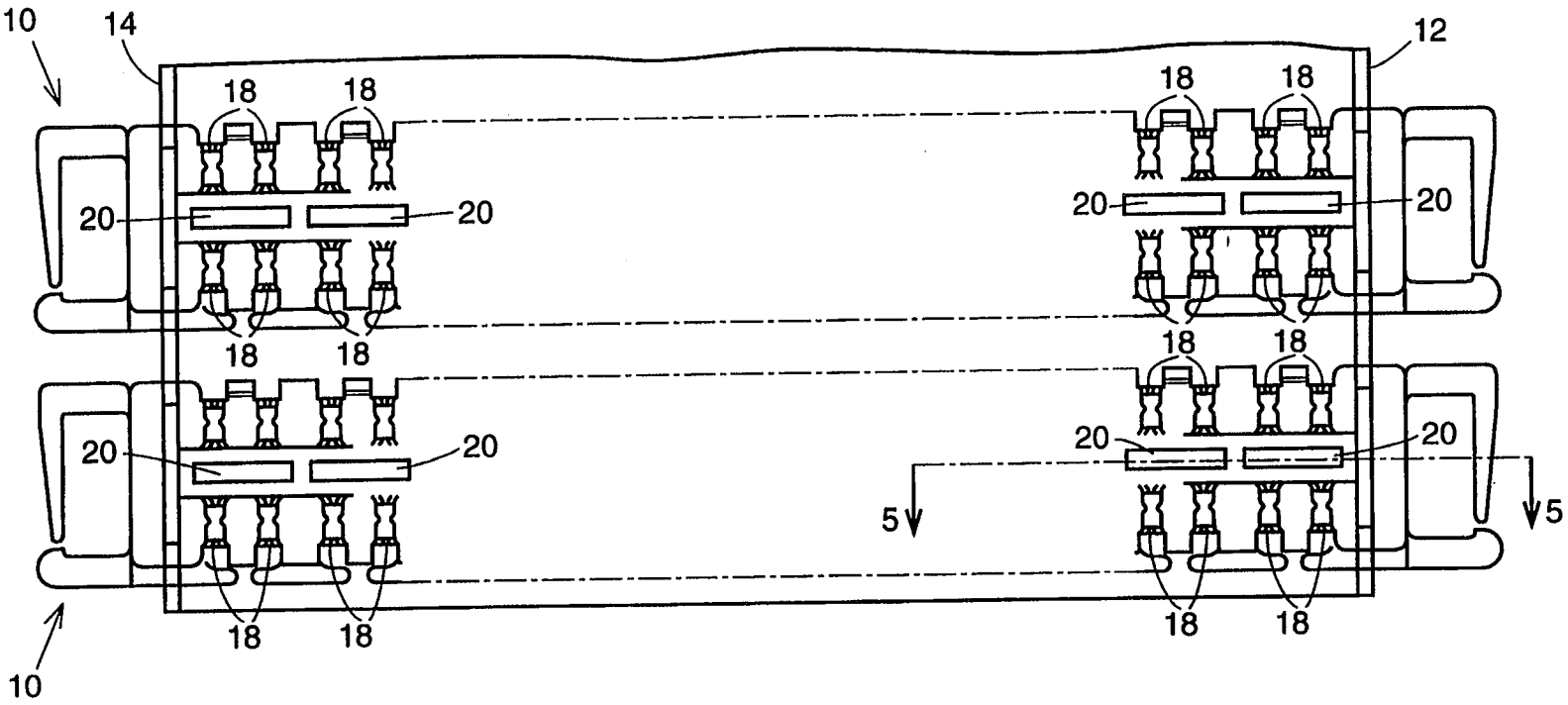
FIG. 2 is a front view of the assembly of FIG. 1.

As shown in FIG. 2 there are provided along the front of the connector strip 10 between the rows of slots 18, a series of narrow apertures 20 into which inserts (not shown) may be inserted. These inserts contact the spring fingers and separate them; and electrically conductive segments on the inserts contact the spring fingers for bringing electrical voltage and/or current out to test, connection or protection devices.

As can also be seen in FIG. 2, several connector strips 10 can be mounted on the rails 12 and 14.

Reverting to FIG. 1 it will be seen that the rails 12 and 14 extend out from opposite edges of a back wall 22 so that the rails and back wall 22 form a trough. This trough should be reasonably rigid and also electrically conductive; and it is preferably made of aluminum or steel. The distance L to which the rails 12 and 14 extend form the back wall 22 can vary depending on the amount of room needed behind the connector strips 10 for wiring and other elements.

Turning now to FIG. 3 it will be seen that the rail 12 of the frame 16 has mounting tabs 24 formed along the front edge thereof. These tabs, as can be seen in FIGS. 1 and 2 extend up into blind recesses 26 formed near the ends of the strip 10. Other mounting means may also be used to hold the strip 10 to the upper edges of the rails 12 and 14.

Figure 5:
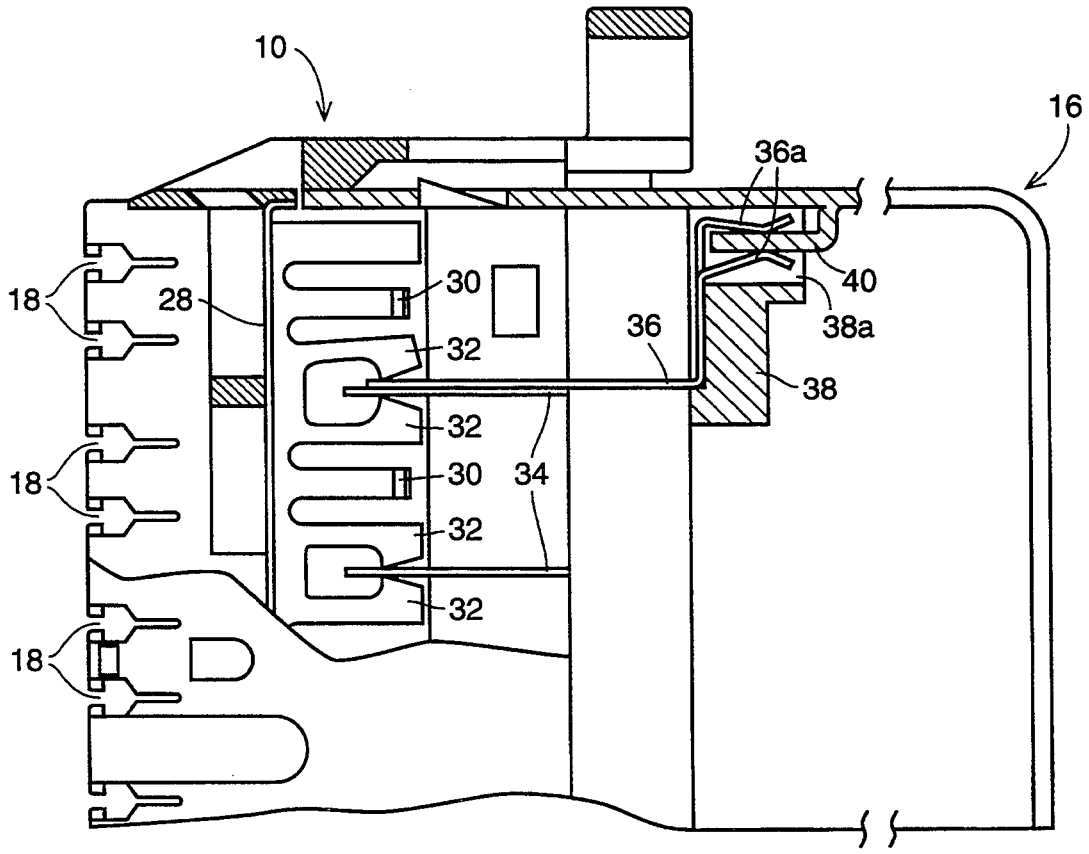
FIG. 5 is a view taken along line 5—5 of FIG. 2.

Turning now to FIG. 5 it will be seen that a ground strip 28 extends along the interior of the connector strip 10. This ground strip, which is made of sheet copper or bronze, has a central spine extending along the length of the connection strip. Spring finger ground contacts 30 are bent out from the spine between adjacent pairs of wire holding slots 18. Also, shield holding wings 32 are bent out from the spine in regions intermediate the spring finger ground contacts. Sheet metal, electrically conductive shields 34 are inserted between each pair of wings 32. These shields 34 and wings 32 are more fully described in U.S. Pat. No. 5,160,272.

As also shown in FIG. 5, an electrically conductive element 36 in the form of a metal strip extends back along one of the shields 34 and through the back of the connector strip 10. The element 36 is bent to extend along the back of the strip 10 and is supported and protected by a plastic subhousing 38 which is attached by an adhesive to the back of the strip 10. At a location close to the rail 12, the conductive element 36 is formed into a pair of spring fingers **36*a* which extend back into open passageway 38*a* in the subhousing 38. The spring fingers 36*a* fit over a flange 40 which is punched and bent out from the rail 12. The spring fingers 36*a* grip the flange 40 on both sides thereof and make good electrical contact with the flange. Thus, large amounts of electrical current can flow from the ground strip 28 and through the conductive element 36 into the flange 40 of the rail 12** in the event of a voltage surge.

Reverting now to FIGS. 3 and 4, it will be seen that a separate flange 40 is bent out of the rail 12 behind each of the connector strip mounting tabs 24. Each flange 40 is made by punching a U-shaped cutout in the rail 12, with the base of the cutout closest to the tab 24. The cutout is then bent in toward the rail 14 and then forwardly to form the flange 40 which extends parallel to the rail 12 a short distance displaced therefrom, and forwardly in a direction toward said connector strip. The flange 40 is on the side of the rail 12 which faces the other rail 14.

The flange 40 can be short, and therefore rigid, irrespective of the distance to the back wall 22 of the frame 16. Thus a good and reliable electrical connection between the rail 12 and the ground elements inside the connector strip 10 can be made each time the connector strip is mounted on the rails 12 and 14.

Figure 6:
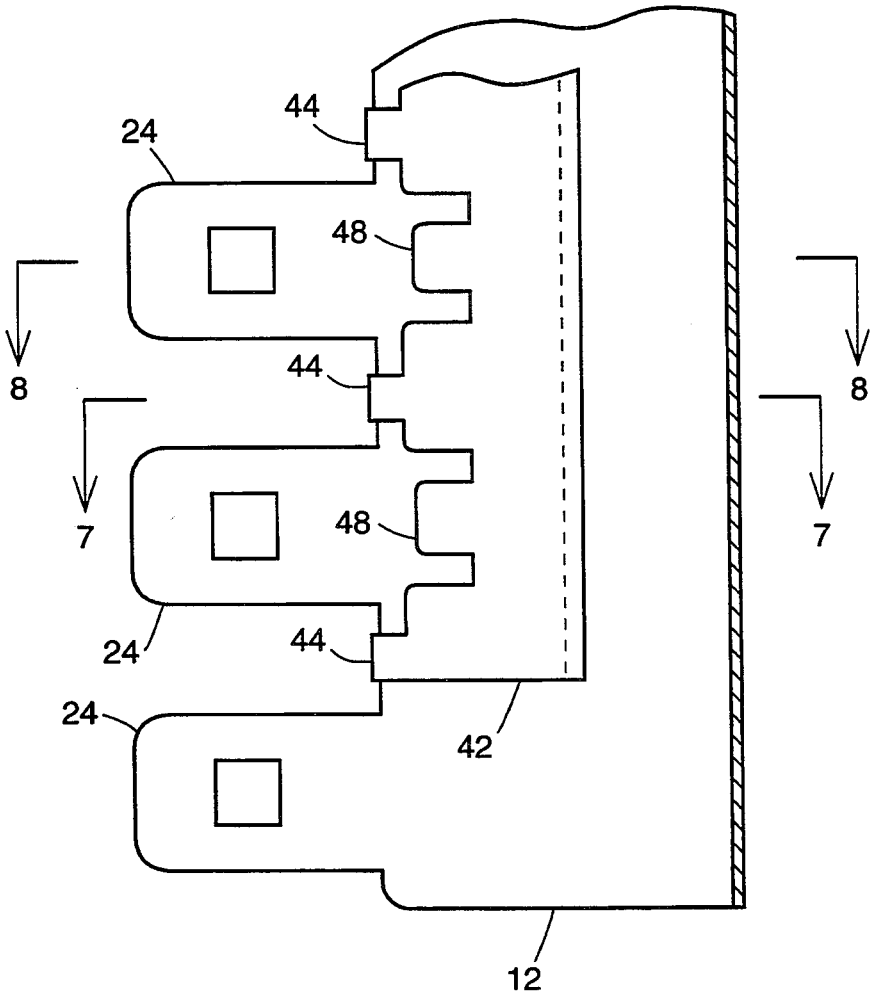
FIG. 6 is a fragmentary side elevational view of a mounting rail and adapter bracket for a second embodiment of the invention.
Figure 7:
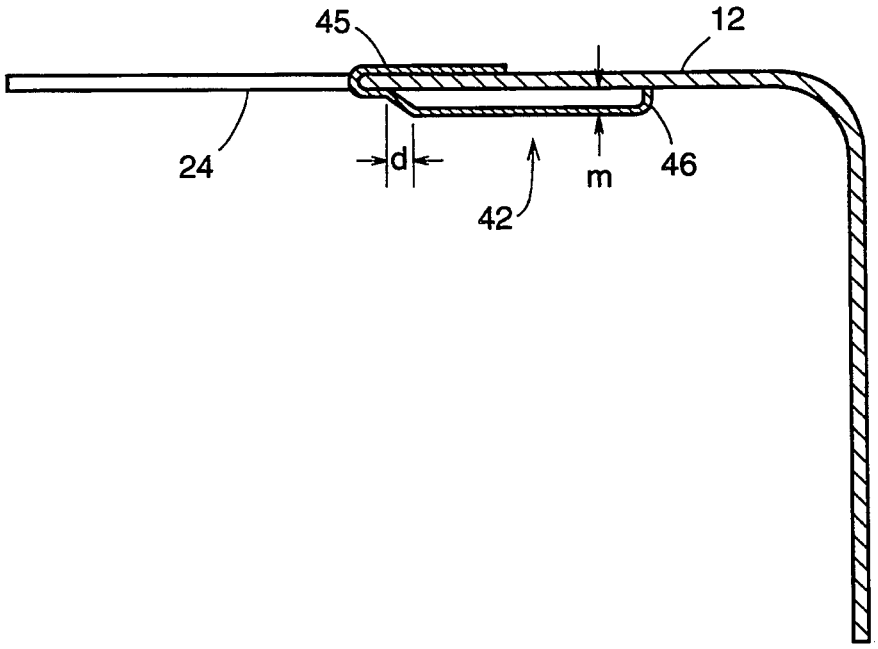
FIG. 7 is a section view taken along line 7—7 of FIG. 6.
Figure 8:
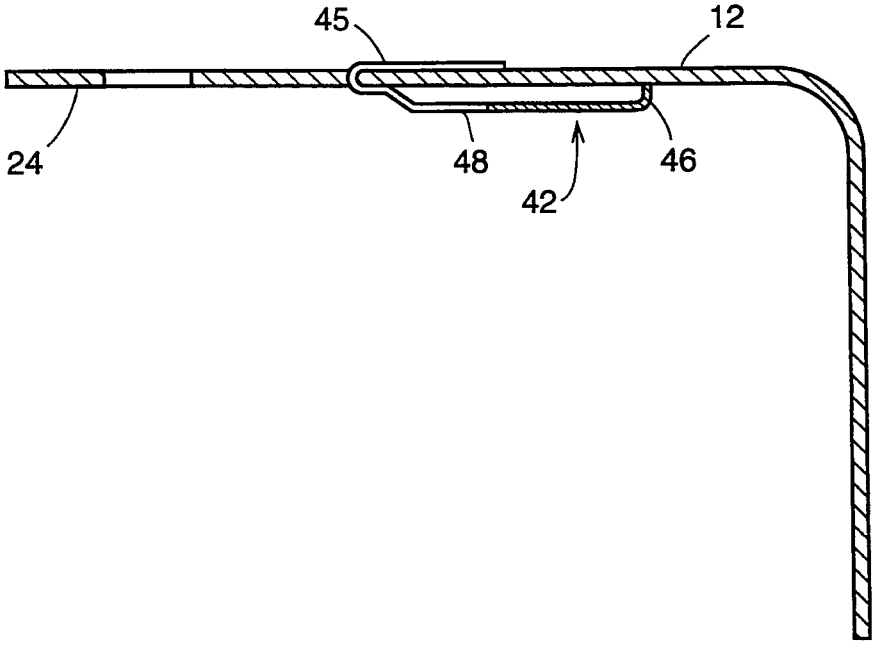
FIG. 8 is a section view taken along line 8—8 of FIG. 6.

FIGS. 6–8 show a second embodiment of the invention which involves an alternate arrangement for forming the flange 40. As can be seen in FIG. 6 a sheet metal adapter bracket 42 is mounted on the rail 12 along its forward edge; and it extends along the length of the rail 12. Extensions 44 of the adapter bracket extend over the forward edge of the rail between the mounting tabs 24. These extensions are bent around the edge of the rail to form hooks 45, as shown in FIG. 7, to hold the adapter bracket in place on the rail and, at the same time, to make good electrical contact with the rail.

The adapter bracket 42 is bent away from the rail 12 at a location a short distance d behind the extensions 44 as shown in FIG. 7. The bracket 42 then extends back parallel to but displaced a short distance m from the rail 12. The rear edge of the adapter bracket is bent back to form an abutment 46 which rests against the rail to maintain the body of the adapter parallel to and displaced by the distance m from the rail.

As shown in FIG. 8, flanges 48 are formed along the adapter bracket 42 between the extensions 44 at locations which correspond to the connector strip mounting tabs 4. These flanges extend out from the body portion of the bracket and are thus parallel to and displaced from the rail 12 by the distance m. It will be appreciated that the flanges 48 in this embodiment are configured and positioned to function in the same manner as the flanges 40 of the first embodiment. This is because the extensions 44 and the abutment 46 make positive electrical contact with the rail 1 while the flanges 48 can be contacted by the spring fingers **36*a* (FIG. 5) of the ground system in the connector strip 10**.

The embodiment of FIGS. 6–8 permits a conventional mounting rail, which does not have ground flanges bent out therefrom, to be easily adapted to provide a grounding function for connector strips mounted thereon.

We claim:

1. A connector strip assembly comprising at least one connector strip made up of an elongated insulative block containing a plurality of closely spaced connectors and a ground strip extending inside said block, a mounting structure on which said connector strip is mounted, said mounting structure comprising a pair of spaced apart, elongated rails, said connector strip extending across and being removably mounted on the upper edges of said rails, at least one of said rails being electrically conductive and having a flange extending out from said rail behind said connector strip, and an electrically conductive clip mounted on the bottom of said connector strip and connected to said ground strip inside said connector strip, said clip being positioned on said connector strip such that it engages and makes electrical contact with said flange when said connector strip is mounted on said rails.

2. A connector strip assembly according to claim 1, wherein said flange is displaced from said one rail and extends parallel to said one rail in a direction toward said connector strip.

3. A connector strip assembly according to claim 2, wherein said flange is bent out from said one rail.

4. A connector strip assembly according to claim 1, wherein said flange is located on the side of said one rail which faces the other rail.

5. A connector strip assembly according to claim 1, wherein said conductive clip is held within a subhousing attached to the back of said connector strip.

6. A connector strip assembly according to claim 5, wherein said conductive element is a metal strip which contacts said conductive strip inside said connector strip and extends through the back of said connector to said subhousing.

7. A connector strip assembly according to claim 1, wherein said flange is formed on an adapter bracket which is removably attached to said rail.

8. A connector strip assembly according to claim 7, wherein said adapter bracket extends along the length of said rail and wherein several of said flanges are formed along the length of said bracket.

9. A connector strip assembly according to claim 8, wherein said bracket includes extensions which are bent to form hooks which hook over the edge of said rail adjacent said connector strip.

10. A connector strip assembly according to claim 9, wherein said bracket is bent away from said rail behind said extension so that the body of said bracket is displaced from and extends parallel to said rail.

11. A connector strip assembly according to claim 10, wherein said bracket includes an abutment element extending along its rear edge, said abutment element being bent in toward said rail and abutting said rail.

12. A connector strip assembly according to claim 11, wherein said flanges extend out from said bracket at locations between said extensions.

* * * * *